United States Patent [19]

Yung et al.

[11] 4,164,600

[45] Aug. 14, 1979

[54] THERMAL BONDING OF POLYESTER POLYBLENDS

[75] Inventors: Kai-Lim W. Yung; Bernard Silverman, both of Raleigh; Virginia C. Menikheim, Chapel Hill, all of N.C.

[73] Assignee: Monsanto Company, St. Louis, Mo.

[21] Appl. No.: 864,882

[22] Filed: Dec. 27, 1977

[51] Int. Cl.[2] ..... B05D 1/14; B32B 7/14

[52] U.S. Cl. ..... 428/198; 264/122; 264/177; 264/248; 428/373; 428/374

[58] Field of Search ..... 428/288, 198, 373, 374; 264/126, 122, 171, 248; 260/857, 78 A, 78 L

[56] References Cited

U.S. PATENT DOCUMENTS

| | | | |
|---|---|---|---|
| 3,522,329 | 7/1970 | Okazaki et al. | 260/857 |
| 3,622,442 | 11/1971 | Reardon | 428/288 |
| 3,862,262 | 1/1975 | Hedrick et al. | 260/78 A |
| 3,944,629 | 3/1976 | Hedrick et al. | 260/78 L |
| 3,993,806 | 11/1976 | Athey | 428/288 |
| 4,031,164 | 6/1977 | Hedrick et al. | 260/78 L |
| 4,034,015 | 7/1977 | Hedrick et al. | 260/78 L |

FOREIGN PATENT DOCUMENTS

| | | | |
|---|---|---|---|
| 49-47422 | 12/1974 | Japan | 264/126 |

*Primary Examiner*—Jay H. Woo

*Attorney, Agent, or Firm*—Howard C. Stanley; Herman O. Bauermeister

[57] ABSTRACT

Melt blended fibers of lactam-polyol-polyacyl lactam or acyl polylactam terpolymers together with polyesters are thermally bonded at temperatures below the bonding temperatures of either the crystalline polyester or the terpolymer, resulting in thermally stable fabrics that have bond strength greater than the individual polyester or terpolymer webs bonded at the same temperature.

12 Claims, No Drawings

THERMAL BONDING OF POLYESTER POLYBLENDS

BACKGROUND OF THE INVENTION

1. Field of the Invention

This invention relates to a process for thermally bonding non-woven materials comprised of two-component melt blends wherein the thermal bonding is achieved at temperatures appreciably lower than the bonding temperature of the lower melting component. More specifically, this invention relates to the process for thermally bonding mixtures of polyesters with terpolymers comprising lactams, polyols and polyacyl lactams at temperatures below the bonding temperature of the individual component polymers. This has been found to result in the composite article such as non-woven fabric having a bonded strength greater than fabrics resulting from, for example, the polyester or the terpolymer bonded individually at the same temperature. In yet another aspect, the invention relates to a thermally bonded non-woven fabric comprised of melt blended fibers of polyester and the said terpolymers.

2. Description of the Prior Art

The fibers comprising a non-woven fabric have in the past been bonded by the use of external binders or by softening the fibers with heat, solvent or plasticizer and subjecting them to pressure while in the softened state. The external binder may be an adhesive substance which is cured after the application thereof or it may be rendered adhesive after application by use of heat, solvent or plasticizer. External binders may be applied as powders, solutions, or emulsions; however, these methods suffer from several disadvantages. The use of an external binder presents problems in uniform application and limits the properties of the entire web to those of the binder. Thus, for example, if an adhesive with a relatively low melting point is used as a bonding material, the temperature conditions to which the web or resulting fabric may be subjected are limited by the melting point of the adhesive.

Solvent bonding by the previous methods is not easily controlled and frequently tends to alter the aesthetic properties of the web. For example, achieving adequate adhesion between the filaments without dissolving the entire web or at least impairing the physical properties thereof is difficult. Furthermore, the intersections at which the filaments are bonded frequently have a swollen appearance which evidences the solution and redeposition of polymer. In most instances, these swollen areas around the bonds do not possess the same dye acceptance level because of changes in the crystalline structure which is localized at the bond site thereby causing non-uniform dyeing.

SUMMARY OF THE INVENTION

Provided herein is a method for production of non-woven fabrics in which bonding of the synthetic filaments and fibrils is achieved without the use of adhesives and excessive pressure. In the following description the term "fibers" includes continuous filaments, staple fibers and yarns thereof. According to the invention it has been observed that lactam-polyol-polyacyl lactam terpolymer fibers and lactam-polyol-acyl polylactam terpolymer fibers, when melt blended with polyesters can be thermally bonded resulting in fabrics having integrity bonding, by heating the contacted fibers to a temperature which is below the bonding temperature of either the polyester or the terpolymer.

The present method employing discrete fibers of a polyester together with a member selected from the group consisting of lactam-polyol-polyacyl lactam terpolymers and lactam-polyol-acyl polylactam terpolymers makes it possible to bond the fibers at points of contact by apparently retarding or inhibiting the crystallization of the said components, although the claims are not limited to any specific mechanism or explanation. The formation of a non-woven fabric from the discrete fibers is accomplished by calendering the fibers as a web between heated rolls, e.g., hot calendering. This may be carried out with plain roll or patterned rolls making possible a patterned bonded fabric. An appropriately patterned roll can be used to produce any desired pattern of heavy or primary bonded segments where the non-woven fabric is nipped between the rolls during calendering. If desired, both rolls may also be patterned to provide a desired design.

In the present process, the use of the said components makes it possible to conduct the thermal bonding at unusually low temperatures, e.g., temperatures appreciably lower than the melting point of either component. For example the fibers of melt blended polyethylene terephthalate together with a lactam-polyol-polyacyl lactam or acyl-polylactam terpolymer can be bonded at temperatures as low as 95° C. into a non-woven fabric. In contrast, the use of crystalline polyethylene terephthalate or lactam terpolymer as the sole component shows no sign of bonding at this temperature. In fact the polyethylene terephthalate requires a bonding temperature of 220° C. and the lactam terpolymer requires a bonding temperature of 180° C.

After the discrete fibers have been bonded as described above, a subsequent annealing or heating step is conducted on the bonded fabric thus permitting normal crystallization and thus producing a fabric which is stable at high temperature conditions. The conventional step of heat setting on a tenter frame can also be applied to the bonded fabrics to provide good dimensional stability even above bonding temperatures.

Annealing is the process by which a polymeric substance in a shaped form, such as synthetic fibers is brought to its equilibrium morphological state. It normally involves heating the polymeric substance either in a stressed or relaxed state to a temperature between the glass transition and melting temperatures. Annealing is desirable because it accelerates the process of crystallization and/or improves the degree of crystallization. After annealing, the polymeric substance has an improved balance of physical properties.

The thermally bonded fabrics of the invention are useful in carpet backing, lining fabrics, drapery fabrics and many other textile and industrial applications.

In order that the inventive process be carried out expeditiously, the melt blended fibers should contain less than about 5% by weight polyol content derived from the terpolymer. The present invention concerns the thermal bonding of webs of melt blended fibers of polyesters and lactam-polyol-polyacyl lactam or acyl-polylactam terpolymers at temperatures lower than the bonding temperature of either component. As the polyol content in the melt blended fibers is increased, the temperature required for bonding passes through a minimum. This minimum occurs at a relatively high polyester content. The thermal bonding of these melt blended fiber combinations of polyesters with the terpolymer component, subjected to heat pressing at a temperature as low as 95° C. has resulted in reasonably good integrity bonding. The temperature of 95° C. is as much as 85° C. lower than the bonding temperature of the lower melting terpolymer component. In comparison, the use of 100% polyester fibers, at such a 95° C. temperature shows no sign of bonding to be perceptible. To obtain even stronger fabrics, higher bonding temperatures are required for all the fibers described above; however, the optimum bonding temperature characteristics of the melt blends still pass through a minimum as the polyol content of the fiber is increased.

According to the present invention, there is provided a method for thermally bonding melt blended fibers containing lactam-polyol-polyacyl lactam or acyl-polylactam terpolymers and polyesters wherein the melt blended fibers have less than about 5% by weight polyol content derived from the terpolymer. A preferred range is 0.1–5 wt. % and a still more preferred range is 0.5–5 wt. % polyol. The process comprises contacting the fibers with one another, heating to a temperature (90° C. to 180° C.) sufficiently high to bond the melt blended fibers, but below the bonding temperature of either the crystalline polyester or the terpolymer component, and crystallizing the fibers. The resultant permanently bonded fabric is stronger than the fabric produced from the polyester web or the terpolymer web alone heat pressed at the same temperature. The manner in which the web of the non-woven fabric is prepared may be in accordance with well-known techniques. In general the proportion of the terpolymers, e.g., the lactam-polyol-polyacyl lactam and acyl-polylactam used in the polyester melt blended fibers permits bonding at temperatures below those required for fibers from either of the components used above.

In a typical forming operation to produce a web, the resin mixture is extruded through downwardly directed spinning nozzles extending towards a foraminous lay-down belt. Here, the filaments form an unbonded web which is then passed between heated bonding rolls. The rolls may be smooth, but are preferably patterned in order to provide discrete points of bonding. By appropriately selecting a web velocity, roll nip pressure and the roll temperature, strong fabrics with a desirable drape and softness can be prepared without an undesirable degree of shrinkage accompanying bonding. The temperature of the heated rolls and the nip pressure should, of course, be selected so as to effect bonding without undesirable accompanying side effects such as web degradation. Particularly appropriate temperatures and pressures are generally influenced to an extent by other parameters such as web speed, web basis weight, polymer characteristics, etc. It has been found that roll temperatures can be about 90° to 180° C. (preferably 120° C. to 170° C.) in combination with nip pressures of about 50–300 PLI (pounds per linear inch). The important thing is that the web does not encounter a temperature where extensive melting occurs. Crystallization of the fibers can be accelerated, when desired, by annealing the fabrics. The annealing of the bonded fabric raises the softening temperature of the fiber composing the fabric, (e.g. annealing at 10°–100° C. above bonding temperature).

It will be appreciated that the fibers must remain in contact during the heating period so that sufficient time is allowed for adhesion between the fibers. However, excessive heating prior to contacting the fibers causes crystallization to occur, thereby raising the temperature required to bond the web. Some crystallization occurs in bonding, and additional crystallization may be imparted to the fabric by annealing after bonding. The fabrics may be heat treated after bonding in order to set them in a given shape.

Other synthetic fibers as well as natural fibers which are not necessarily affected under the process conditions of the invention may be dispersed between the fibers of the non-woven web and therefore become incorporated in the non-woven fabric. Such other fibers become incorporated in the web either by adhesion to the mass of fibers resulting from thermal bonding, or by being maintained in position by the bonded fibers. If desired, additional bonding between the dispersed fibers, as well as between the dispersed and bonded fibers can be brought about by known bonding means.

DETAILED DESCRIPTION OF THE PREFERRED EMBODIMENTS

It is contemplated that the thermal bonding of the present invention may be carried out in a continuous process. The present invention concerns thermal bonding of melt blended fibers comprised of polyesters and lactam terpolymers wherein the melt blended fiber is preferably comprised of 0.1 wt. % to 5% (or preferably 0.5 to 5 wt. %) polyol derived from the terpolymer, said thermal bonding occurring at temperatures lower than the bonding temperature of either component. While the present invention is not postulated upon any specific mechanism, it is possible that the terpolymer inhibits crystallization of the melt blend of fibers thus allowing the fibers to be bonded at lower temperatures than the bonding temperatures of either fiber component.

The present phenomenon of controlling crystallization indicates that in the range of 0.1 to 5 wt. % polyol content it is possible to inhibit the crystallization until after the completion of a forming or other operation, such as bonding of a non-woven web. However, the web can then be annealed, e.g., at 10° C. to 100° C. above the web bonding temperature. The annealing then results in crystallization of the bonded fabric.

The polyol containing terpolymers also called lactam terpolymers are preferably comprised of lactam-polyol-polyacyl lactam or lactam-polyol-acyl polylactam terpolymers having sufficient polyol content by weight to provide the polyester melt blends thereof with a polyol content by weight of 0.1 to 5% by weight. These terpolymers are characterized as having ester, imide, and hydroxy end group termination, as well as both ester linkages and amide linkages between monomeric segments. Terpolymers may be prepared by an anionic catalyzed polymerization with a polyester initiator and the terpolymers are formed from dicarboxylic acid esters and aliphatic polyols and/or aliphatic polyether polyols; as well as through a process comprised of reacting together lactams, polyols, and polyacyl or acyl-polylactams (preferably with alcohol as a solvent medium) in the presence of a basic lactam polymerization catalyst. The terpolymers are melt blended with polyester polymers comprised of high molecular weight, linear polyester, particularly those containing an aromatic ring or rings such as polyethylene terephthalate and a polyethylene isophthalate. It is also permissible to use more than one polyester component. Any polyester resin, for example any of the large group of synthetic resins produced by the reaction of dibasic acids with dihydric alcohols are suitable for melt blend purposes according to the invention. In fact, any fiber forming polyester is suitable for melt blending with the polyol containing terpolymers.

While the physical properties of elected polyester and terpolymer melt blended fabric samples are demonstrated in the following examples, there is no reason to believe that these particular examples represent the best bonding strength and other properties attainable. The variables involved in this invention include the various compositions of the polyester and terpolymer component melt blends, the speed, the pressure and temperature of pressing roll and the polyol content of the terpolymer.

The terpolymer can also be used in combination with a polyester as a melt blended fiber in end uses such as producer oriented yarns since the terpolymers prevent premature crystallization of the fiber. This is important in increasing the shelf life of fibers which are used in draw-texturing operations.

The following examples illustrate specific embodiments of the invention, but are not limitative of the scope of the invention.

EXAMPLE 1 & 2

Non-woven fabrics are prepared beginning with polyethylene terephthalate (PET) in combination with a lactam terpolymer. (The latter component is based upon 30% by wt. of ethylene glycol). The above two respective polymers are employed as a molten blend for extrusion through spinnerettes having 9 mil diameter holes which are 12 mil deep.

TABLE I

| Extrusion and Fiber Spinning | Example 1 | Example 2 |
|---|---|---|
| Blend Composition (Wt. % (PET/ lactam terpol.) | 85/15 (4.5 Wt. % Polyol) | 85/15 (4.5 Wt. % Polyol) |
| Spinning Temperature (°C.) | 285°-295° C. | 285°-295° C. |

The above blends (expressed as weight proportion of the total blend) are extruded through the spinnerettes as a group of fibers which are allowed to fall to the collection area and from there pass between rolls (at least one of which is heated) for bonding into a non-woven fabric. The bonding temperatures and the speed of bonding of the web are shown in the following table which also sets forth the physical properties of the resultant non-woven fabric.

TABLE II

| Physical Properties | Example 1 | Example 2 |
|---|---|---|
| Fabric Composition (Wt. %) | 85/15 PET/ lactam terpol. (4.5% Polyol) | 85/15 PET/ (lactam terpol) (4.5% Polyol) |
| Pressing Temperature - °C. | 140 | 95 |
| Speed of Pressing - ft/min | 10 | 10 |
| Dry Tests | | |
| Fabric Weight (oz/yd$^2$) | 1.79 | 1.18 |
| Strip Tenacity (PIOSY) | 4.19 | 1.50 |
| Zero Span Tenacity (PIOSY) | 6.00 | 8.71 |
| Strip Elongation (%) | 146.6 | 8.80 |
| Strip Modulus (PIOSY) | 31.64 | 61.40 |
| Bonding Efficiency (%) | 69.7 | 17.1 |
| Tongue Tear (PIOSY) | 1.77 | 1.23 |
| Mullen Burst (PSI) | 22.3 | 17.2 |
| Bending Length (inch) | 1.74 | 1.52 |
| Average Abrasion Resistance (Cycles) | 2.0 | 1.0 |
| Wet Tests | | |

TABLE II-continued

| Physical Properties | Example 1 | Example 2 |
|---|---|---|
| Strip Tenacity (PIOSY) | 3.34 | 1.36 |
| Zero Span Tenacity (PIOSY) | 5.69 | 6.61 |
| Strip Elongation (%) | 109.9 | 6.20 |
| Strip Modulus (PIOSY) | 35.12 | 62.6 |
| Rupture Energy (PI) | 3.36 | — |
| Bonding Efficiency (%) | 59.9 | 20.5 |

POISY indicates pounds per inch per ounce per square yard, PI indicates pound inch, POSY indicates pounds per ounce per square yard and PSI indicates pounds per square inch).

The above data show that non-woven fabrics are effectively bonded at temperatures below the bonding temperature of webs from fibers of either of the individual components, specifically 220° C. for polyethylene terephthalate and 180° C. for the lactam block terpolymer.

Samples pressed at a variety of temperatures show that an effective temperature range for bonding is from 90° C. to 180° C., a preferred temperature range being from 120° C. to 170° C.

The use of the lactam terpolymer together with polyethylene terephthalate apparently makes is possible to inhibit the crystallization of the polyethylene terephthalate. Thus the product non-woven fabric has the advantage of being readily handled in a non-crystalline form, but may be crystallized when desired in order to improve other properties, e.g., tensile strength, dimensional stability, such as to heat and to water, etc.

EXAMPLE 3 & 4

The use of polybutylene terephthalate gives results similar to the use of polyethylene terephthalate described above. The presence of the additional lactam-polyol-acyl lactam terpolymer makes it possible to form non-woven fabrics at temperatures lower than the bonding temperature of either component of this binary blend.

The physical properties of the melt blended fibers, based upon the use of polybutylene terephthalate and lactone-polyol-acyl lactone terpolymer, as used for non-woven fabrics are shown below.

TABLE III

| Polybutylene terephthalate/lactam terpolymer Fibers | Example 3 | Example 4 |
|---|---|---|
| Composition Polybutylene terephthalate/ lactam terpolymer | 85/15 (PBT/ lactam terpolymer) (4.5 Wt. % Polyol) | 100/0 (0% Polyol) |
| Draw Ratio | (4X) | (4X) |
| Filament Denier | 21.4 | 3.2 |
| Breaking Elongation (%) | 75.4 | 92.6 |
| Tenacity (gm/den) | 2.94 | 2.95 |
| Initial Modulus (gm/den) | 13.8 | 21.1 |
| Rupture Energy (gm/cm) | 4.9 | 3.5 |
| Elastic Recovery (%) at 5% Extension | 92.0 | 95.4 |

The above data show that physical properties based upon polybutylene terephthalate, like polyethylene terephthalate, are substantially retained in adding the lactam terpolymer.

Another embodiment of the invention is the use of the melt-blend of the polyester and the lactam terpolymers with another polymer component to form composite articles such as side by side bicomponent, or sheath core fibers, e.g. with the said melt blend as the sheath, and the other polymer component as the core. These fibers are useful in non-woven fabrics. The said melt blend used for the aforesaid purposes should contain at least 0.1 wt. % polyol (or preferably 0.5 to 5% by weight), and should comprise at least 5% by weight in the composite article. Polymers such as polyamides e.g. nylon 66, polyesters e.g. polyethylene terephthalate or other polymer melt blends, etc. can be physically combined with the said melt blend of the polyesters and the lactam terpolymer to form the composite articles. If desired, additives such as flame retardant agents, e.g. tri-(2,3-dibromopropyl) phosphate can also be employed in either of the physical components of the composite fiber to achieve certain desired properties.

The general method for producing the composite articles comprises forming a melt stream of a blend of a polyester and a lactam terpolymer, which blend has at least 0.1 wt. % polyol content, and also forming a melt stream of another polymeric substance, specifically polyethylene terephthalate or nylon 66, and extruding the said two melt streams together in the configuration for example as a sheath core, a side by side composite fiber or other shaped article. The said composite product has at least 5% by weight of the said blend in the total composite article. Preferred embodiments of the invention are sheath core fibers for example with the blend of the polyester and the lactam terpolymer as the sheath, and with the other polymeric substance, preferably polyethylene terephthalate or nylon 66 as the core of the sheath core fiber. Another preferred embodiment is a side by side composite fiber with the aforesaid components as the two side by side members.

Another embodiment of the invention is the use of the composite article such as sheath core or side by side composite fibers as used in the production of non-woven fabrics. For this purpose the fibers are produced as described above and are then assembled such as by random deposition on a moving belt to form a web. The web is then heat pressed. When utilizing the said melt blends of the polyester with the lactam terpolymer in the composite fibers, the heat pressing temperature is from 90° C. to 210° C., or preferably 90° C. to 180° C.

The polyesters of the present invention are prepared by heating together dihydric alcohols or functional derivatives thereof and dibasic carboxylic acids or polyester-forming derivatives thereof such as acid halides, salts, or simple esters of volatile alcohols. Highly polymerized polyesters can be formed into filaments, fibers, films and the like which can be permanently oriented. The most widely known and most important commercially of the polymeric polyesters are that prepared by the condensation of terephthalic acid or dimethyl terephthalate and ethylene glycol or butylene glycol. Carboxylic acids or polyester-forming derivatives thereof may be employed to make polyesters but more preferably are aromatic dibasic dicarboxylic acids or dialkyl esters thereof. Of particular value is terephthalic acid and dialkyl esters thereof such as dimethyl terephthalate and similar dialkyl esters wherein the alkyl groups are the same or different alkyl radicals, preferably alkyl hydrocarbon radicals containing 1 to 5 carbon atoms thereof. Isophthalic acid and its dialkyl esters also may be employed to make the modified polyesters of this invention. Other useful aromatic dicarboxylic acids or esters thereof which may be used include p,p'-dicarboxy diphenyl, naphthalene dicarboxylic acids such as 2,6-dicarboxy naphthalene; p,p'-dicarboxy diphenylsulfone, p,p'-dicarboxyphenoxyethane and the like. Aliphatic dicarboxylic acids such as adipic, succinic, sebacic and the like may be substituted in part for the aryl dicarboxylic acids.

The other component of the present blends is a lactam terpolymer or more specifically a terpolymer of lactampolyol-polyacyl lactam or lactam polyol-acyl-polylactam (U.S. Pat. No. 3,862,262).

These terpolymers can be additionally characterized by as having ester, amide, and/or hydroxy end group termination, as well as both ester linkages and amide linkages between monomeric segments thereof. The terpolymers may be prepared by an anionic catalyzed polymerization with a polyester initiator, and the terpolymer is formed from dicarboxylic acid esters and aliphatic polyols and/or aliphatic polyether polyols; as well as through a process comprised of polymerizing together lactams, polyols and polyacyl or acyl polylactams and an alcohol in the presence of a base lactam polymerization catalyst.

The lactam terpolymer as described below is based upon various moieties as components of a block terpolymer. For example, in the embodiment of the lactam-polyol-polyacyl lactam terpolymer, the lactam may be caprolactam, the polyol may be 1,4-butanediol or polyethylene glycol, and the polyacyl lactam may be tetraphthaloyl biscaprolactam or 1,3-benzene disulfonyl caprolactam.

A preferred monomer of the terpolymer is ε-caprolactam. Lactam monomers in addition to ε-caprolactam include alphapyrrolidinone, piperidone, valerolactam, caprolactams other than the ε-isomer, capryllactam, lauryllactam and the like. In addition to lactams unsubstituted on their carbon chains, lactams having substituents on the carbon chain which do not inhibit or otherwise adversely affect the polymerization of the lactam are also included within the scope of this invention.

During polymerization the cyclic lactam ring is opened to provide the following monomeric unit $$-\overset{\overset{\displaystyle O}{\|}}{C}-Y-NH-$$

which, together with other lactam molecules, produces a polymeric block of the formula $$-\left(\overset{\overset{\displaystyle O}{\|}}{C}-Y-NH\right)_x-$$

where x is an integer greater than one. The monomeric lactam unit can also react with the polyacyl alkoxide. Similarly, a polylactam block, when joined with a polyacyl unit forms a polymer segment of the formula $$-\left(\overset{\overset{\displaystyle O}{\|}}{C}-Y-NH\right)_x-\left(A-R\right)_b-\left(A'\right)_y-$$

where R is a hydrocarbon group described hereinbelow, A and A' are acyl groups, x is an integer greater than one, y is an integer equal to or greater than one, and b is an integer equal to zero or one.

In the course of the polymerization of the components described above, a polyol can react with the polymerizable lactam unit or block to produce a polymer segment of the formula $$-\left(O-Z\right)_n-O-\left(\overset{O}{\overset{\|}{C}}-Y-NH\right)_x-$$

where x and n are integers equal to at least one and where Z is a hydrocarbon, substituted hydrocarbon or acylated hydrocarbon group which, together with the oxygen atom attached thereto, forms a polyether or polyester segment of a polymer molecule.

The Z hydrocarbon, substituted hydrocarbon and acylated hydrocarbon groups can be of any size even polymeric such as polybutadiene, generally limited to about six carbon atoms, said groups being preferably alkylene, arylene, alkylene carbonyl, arylene carbonyl, and mixtures thereof. Even more preferred are unsubstituted aliphatic groups such as methylene, ethylene, propylene, butylene and the like. Other suitable Z groups include phenylene, chlorophenylene, tolylene, isobutylene, isopropylene, ethylcarbonyl, propylcarbonyl, ethylsulfonyl, propylthiocarbonyl and the like.

The preference indicated above for unsubstituted aliphatic Z groups means that terpolymers of this invention which contain polyether segments are preferred over other embodiments which contain polyester segments.

In preferred aspects of this invention, it is theorized that the lactam is present in the polymer in the form of polylactam blocks which are alternated with blocks of polyol and polyol segments to form the polymer. The polylactam blocks when present can be of any size but customarily have molecular weights of at least about 500, preferably at least about 1000.

The polymerized polyol components of the polymers of this invention are formed from polyol intermediates having at least two hydroxy groups. Available commercial polyols of this class are produced by reacting, for example, propylene oxide or ethylene oxide with glycols, glycerol, pentaerythritol, glucose, amines, and the like. Included within the scope of the above class are a large number of suitable compounds ranging from the simple diols such as ethylene glycol to complex polymeric polyols such as poly (ε-caprolactone) diol. Other polyol compounds include alkylene glycols such as diethylene glycol, triethylene glycol, tetraethylene glycol, tetramethylene glycol, propylene glycol, dipropylene glycol, hexylene glycol, 1,2-propanediol, 1,3-propanediol, 1,3-hexanediol, 1,5-pentanediol, butylene glycol, 1,4-butanediol, dicyclopentadiene glycol, heptaethylene glycol and isopropylidene bis (p-phenyleneoxypropanol-2); diols other than alkylene glycols such as pyrocatechol, resorcinol, hydroquinone, hydroxyethyl acrylate and hydroxypropyl methacrylate; polyols having more than two hydroxy functions such as glycerol, pentaerythritol, 1,2,6-hexanetriol, 1-trimethylol propane, pyrogallol and phloroglucinol; polymeric polyols such as polyethylene glycols, polypropylene glycols, polyoxypropylene diols and triols, castor oils, polybutadiene glycols and polyester glycols, and a large number of compounds containing substituents other than hydroxy groups such as 2,4-dichlorobutylene glycol and 2,2'-4,4' bis (chlorohydroxy0 phenyl) ether. In addition to all the hydroxy compounds set forth above, the thio compounds analogous to the above compounds having sulfur atoms in place of oxygen are also included within the scope of the invention. A few examples include hydroxyethyl thioglycolate, ethylene glycol bis(thioglycolate), pentaerythritol tetrakis-(thioglycolate) and thiodiglycol.

If the polyol intermediate is a polymer, the molecular weight of the polyol can be any amount. Commercially available polymeric polyol compounds have molecular weights from 200 to 5000, but polymers with molecular weights outside that range are also useful in the practice of the instant invention. If the polyol intermediate or segment is a single molecule having at least two hydroxy groups such as ethylene glycol, a suitable polyol segment according to the invention would have a molecular weight of at least 62.

The third component of the terpolymers has the following structural configuration in the polymer chain:

$$-\left(A-R\right)_b-\left(A'\right)_y-$$

where R is a hydrocarbon group, A and A' are acyl radicals, y is an integer equal to at least one, and b is an integer equal to zero or one.

The R group can be any hydrocarbon group having at least two valence bonds for attachment to the acyl groups shown in the above formula. Examples include functional groups obtained by the removal of hydrogen atoms from methane, ethane, propane, hexane, dodecane, benzene, toluene, cyclohexane and the like. The polyvalent R group can be of any size but is preferably limited to about twenty carbon atoms, and more preferably about eight carbon atoms. If the integer "y" is one, the linkage will be a diacyl group. The A group can be any acyl group and preferably are $$-\overset{O}{\overset{\|}{C}}-,\ -\overset{S}{\overset{\|}{C}}-,\ -\overset{O}{\overset{\|}{\underset{\underset{O}{\|}}{S}}}-,\ \text{or}\ -\overset{O}{\overset{\|}{\underset{|}{P}}}-$$

groups. Most preferred among the above groups is the carbonyl group.

Values for the integer "y" have a direct relationship to the thermoplasticity of the terpolymer. If the integer "y" is greater than one, the linkage will be a higher polyacyl. The higher the value of "y", the more highly crosslinked will be the finished polymer. Values for "y" can be as high as six or eight, but more preferably do not exceed two or three.

The polymerized product comprising the aforementioned components can have a number of different structures depending upon the process conditions and the relative proportions of ingredients used in the reaction system. Polymers can be prepared having relatively small segments of lactam units joined to similarly short segments of polyol units through the polyacyl linkage described above. Or large segments of one polymeric component can be combined with a larger number of comparatively small segments of another polymeric unit, which small segments are joined to one another through the polyacyl linkage as well as to the other type of polymeric component. Or segments of varying sizes of both the lactam and the polyol polymeric units can be combined through the polyacyl components to form a highly random terpolymer. Another form of polymer within the scope of this invention are block polymers, where moderately large size blocks or segments of the lactam and polyol polymeric units are positioned alternately in the polymer chain and joined through the polyacyl group described above. If the polyacyl linkages are, for purposes of simplification, considered to be a part of either a lactam or polyol block, then the block polymers of this invention can be discussed in terms of two alternating blocks designated as A and B blocks, instead of in terms of complicated patterns of three blocks designated as A, B and C blocks. Block polymers prepared according to this invention can have three general structural configurations, AB, ABA and a repeating pattern of AB segments. Following a general characterization of a block copolymer prepared within the scope of this invention as AB, ABA or repeating AB, it should be recognized that the exact structural configuration may vary somewhat from the general characterization of the polymer. As an illustration, one theoretical formula for a lactam-polyolpolyacyl lactam block terpolymer of the repeating AB type could be both of the AB, ABA as well as the repeating AB type, will become immediately apparent to those skilled in the art in view of this disclosure. It should therefore be noted that the above structural formula is set forth for illustrative purpose only, and is not intended as a limitation of the polymers within the scope of the invention.

When the polymers of this invention are of the ABA type, where one block of one type of polymer segment is located between two blocks of the other type of polymer segment, the polymers can be of either the polyol-lactam-polyol type or the lactam-polyol-lactam type. Of the two types, the latter is a preferred type of ABA polymer.

If the lactam-polyol-polyacyl lactam polymer is a block polymer, the polyol blocks can, like the polylactam blocks, be of any size but customarily have molecular weights of at least about 500, preferably at least about 1000. The ratio of the number of lactam to polyol blocks can also vary. Since the block polymers can be of either the type designated as AB, ABA or repeating AB, the ratio of lactam blocks to polyol blocks can vary from 2:1 to 1:1 to 1:2. Mixtures of two or more block polymers having different ratios of the lactam and polyol blocks will produce ratios of polymer blocks intermediate between the above stated ratios.

In the above theoretical formula for a lactampolyol $$R'-O-\left[\left(\overset{O}{\overset{\|}{C}}-Y-NH\right)_x-\left(A-R\right)_b-\left(A'\right)_y-\left(NH-Y-\overset{O}{\overset{\|}{C}}\right)_{x'}-\left(O-Z\right)_n-O\right]_w-$$

$$-\left(A-R\right)_b-\left(A'\right)_y\left(NH-Y-\overset{O}{\overset{\|}{C}}\right)_{x''}-O-R'$$

where y, x, x', x'', n and w are all integers equal to one or more; b is an integer equal to zero or one; R is a divalent or polyvalent hydrocarbon group; $(O-Z)_n$ is a polyol segment or a polymeric moiety and Z is a hydrocarbon or substituted hydrocarbon group; Y is an alkylene group having at least three carbon atoms; A and A' are acyl groups; and R' is an aliphatic or substituted aliphatic hydrocarbon wherein the ester group is attached to other than an aromatic radical.

If for instance Y is a straight chained alkylene group, A and A' are carbonyl groups, Z is ethylene, $-CH_2CH_2-$, and R is phenylene, the terpolymer would be a caprolactam-ethylene glycol polymer where the caprolactam segments of the polymer are joined to one another and to the ethylene glycol segments through terephthaloyl linkages. Other lactam-polyol polymers, block terpolymer, the polyacyl linkage is represented as located between two lactam polymer segments as well as between a polyether segment and a lactam polymer segment. As a practical matter, the polyacyl linkages will also be located occasionally between two polyol blocks. It should be noted, moreover, that the polyacyl linkages need not invariably be psoitioned between lactam and polyol blocks since the necessary linkage can be provided in the form of an ester linkage by the oxygen atom of the polyether segment and the carbonyl group of a polylactam segment.

Following is a general characterization of the lactam polyol-polyacyl lactam terpolymer produced according to the invention. As an illustration, the lactam-polyol-polyacyl lactam or acyl polylactam terpolymer has the general formula:

$$R'-O-\left[\left(\overset{O}{\overset{\|}{C}}-Y-NH\right)_x-\left(A-R\right)_b-\left(A'\right)_y-\left(NH-Y-\overset{O}{\overset{\|}{C}}\right)_{x'}-\left(O-Z\right)_n-O\right]_w-$$

-continued $$-\left(\overset{O}{\overset{\|}{C}}-Y-NH\right)_{x''}-\left(A-R\right)_{b}-\left(A'\right)_{y}-\left(NH-Y-\overset{O}{\overset{\|}{C}}\right)_{x'''}-O-R'$$

Wherein $(O-Z)_n$ is a polyol segment or a polymeric moiety and Z is a hydrocarbon or substituted hydrocarbon group said group being alkylene, arylene, alkylene carbonyl, arylene carbonyl, and mixtures thereof; A and A' are acyl groups selected from $$-\overset{O}{\overset{\|}{C}}-,\ -\overset{S}{\overset{\|}{C}}-,\ -\underset{\underset{O}{\|}}{\overset{O}{\overset{\|}{S}}}-,\ \text{or}\ -\underset{\underset{|}{}}{\overset{O}{\overset{\|}{P}}}-;$$

R is a polyvalent hydrocarbon group;

Y is an alkylene or substituted alkylene having from about 3 to about 14 carbon atoms;

y is an integer equal to at least one, and b is an integer equal to zero or one; x, x', x'' and x''' are integers and the total number of x's is equal to 2 w+2; and n and w are integers equal to one or more.

What is claimed is:

1. A process for thermally bonding fibers comprising forming fibers from a melt blend comprising a polyester and a terpolymer selected from the class consisting of lactam-polyol-polyacyl lactam and acyl-polylactam terpolymers, said fibers having present a crystallization inhibiting amount of the said terpolymer, contacting the fibers with one another, heating the contacted fibers to a temperature which is below the bonding temperature of either the said polyester or the said terpolymer, resulting in a permanent bonding of the melt blended fibers as a fabric, and thereafter annealing the contacted fibers to at least partially crystallize the same.

2. A process for thermally bonding fibers comprising forming fibers from a melt blend comprising a polyester and a terpolymer selected from the class consisting of lactam-polyol-polyacyl lactam and acyl-polylactam terpolymers, said fibers having present less than about 5% by weight polyol content arising from the said terpolymer, based on the weight of the melt blend, contacting the fibers with one another, heating the contacted fibers to a temperature which is below the bonding temperature of either the said polyester or the said terpolymer, resulting in a permanent bonding of the melt blended fibers as a fabric, and thereafter annealing the contacted fibers to at least partially crystallize the same.

3. A process according to claim 1 wherein pressure is applied to the contacted fibers during the heating process.

4. A process according to claim 1 wherein the said polyester is polyethylene terephthalate.

5. A process according to claim 1 wherein the polyester is polybutylene terephthalate.

6. A process according to claim 1 where there is present from about 0.1 to 5% by weight polyol content arising from the said terpolymer based on the weight of the melt blend.

7. A process according to claim 1 wherein the resulting bonded fabric has a strength greater than the strength of the individual polyester or the terpolymer fabrics bonded, respectively at the same temperature.

8. A thermally bonded nonwoven fabric comprised of fibers formed from a melt blend comprising a polyester and a terpolymer selected from the class consisting of lactam-polyol-polyacyl lactam or acyl-polylactam terpolymers, said fibers having a crystallization inhibiting amount of said terpolymer.

9. A nonwoven fabric according to claim 6 wherein the polyester is polyethylene terephthalate.

10. A process for thermally bonding fibers formed from a melt blend comprising a polyester and a terpolymer selected from the class consisting of lactam-polyol-polyacyl lactam and acyl-polylactam terpolymers, said fibers having present a crystallization inhibiting amount of the said terpolymer, contacting the fibers with one another, heating the contacted fibers to a temperature which is below the bonding temperature of either said polyester or said terpolymer, resulting in a permanent bonding of the fibers as a fabric.

11. A process of producing a composite article which comprises forming a melt stream of a melt blend comprising a polyester and a lactam terpolymer, which blend has less than 5 wt. % polyol content based on the weight of the melt blend, forming a melt stream of another polymeric substance, and extruding the said two melt streams together in a composite configuration, the said composite configuration having at least 5% by wt. of the said melt blend in the total composite article.

12. The product produced by the process of claim 11.

* * * * *